United States Patent [19]

Christensen

[11] 4,378,924

[45] Apr. 5, 1983

[54] BAG HOLDER

[76] Inventor: James H. Christensen, 2736 Ensign Ave. North, Minneapolis, Minn. 55427

[21] Appl. No.: 271,523

[22] Filed: Jun. 8, 1981

[51] Int. Cl.[3] ..... B65B 67/04

[52] U.S. Cl. ..... 248/101

[58] Field of Search ..... 248/95, 97, 99, 100, 248/101; 141/314, 391; 232/43.2

[56] References Cited

U.S. PATENT DOCUMENTS

| | | | |
|---|---|---|---|
| 1,322,445 | 11/1919 | Hyer | 248/99 X |
| 2,606,485 | 8/1952 | Miller | 248/99 X |
| 3,866,872 | 2/1975 | Burgess | 248/97 |
| 3,870,261 | 3/1975 | McSwain | 248/101 |
| 4,238,868 | 12/1980 | Sternberg | 248/101 X |
| 4,304,379 | 12/1981 | Christensen | 248/101 |

*Primary Examiner*—J. Franklin Foss

*Attorney, Agent, or Firm*—John W. Adams

[57] ABSTRACT

A bag holder including a mounting ring for providing circumferential support for the upper open end of a bag, and a clamping element pivotally mounted on said ring to permit clamping and anchoring the mouth of the bag to the mounting ring, and also including retaining means underlying the front portion of the underside of the ring with means for supporting the ring and means for covering the opening formed by the ring and clamping element.

2 Claims, 6 Drawing Figures

BAG HOLDER

BACKGROUND OF THE INVENTION

This invention is related to the invention disclosed and claimed in presently pending U.S. application Ser. No. 079,982, filed Sept. 28, 1979 now U.S. Pat. No. 4,304,379, and entitled Bag Holder. The present invention embodies the advantages of my prior invention but also includes a simplified concept for locking the clamping ring and bag to the mounting ring unit.

SUMMARY OF THE INVENTION

This invention provides a mounting ring member to be attached to a suitable support and provided with a grooved clamping member which is pivotally mounted on the rear portion of the mounting ring to permit the same to be lifted on said pivotal mounting and permit a bag to be mounted over the mounting ring and secured thereto by shifting the clamping ring segment downwardly into mated positively locked relationship with the mounting ring. The cross sectional configuration of clamping ring member has a thickened outer cross sectional portion which materially strengthens the clamping action around substantially the entire circumferential length of the clamping member and is further provided with an rearwardly extending retaining lip extending around substantial portion of the outer circumferential length of said clamping member to surround more than 180° of the cross sectional circumference of the mounting ring when in clamped position. A forwardly extending protuberance is also provided to further stiffen the forward center portion of the retaining lip and clamping ring segment while providing a gripping handle for raising and lowering the same.

DESCRIPTIONS OF THE DRAWINGS

DETAILED DESCRIPTION OF A PREFERRED EMBODIMENT OF THE INVENTION

Figure 1:
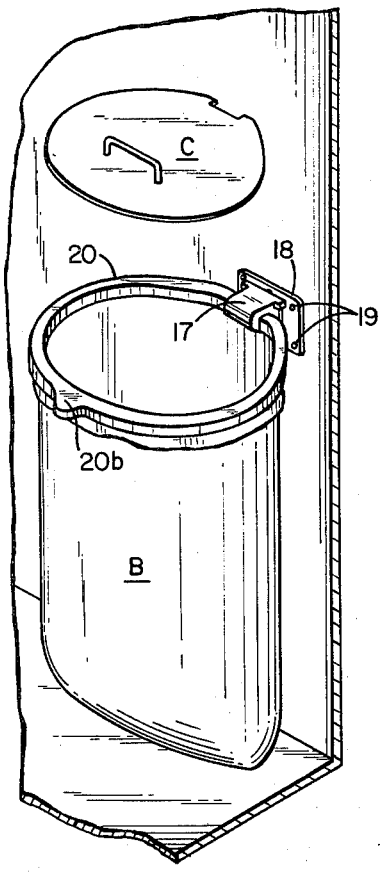
FIG. 1 is a perspective view showing my bag holder in operative position with a bag mounted thereon.
Figure 2:
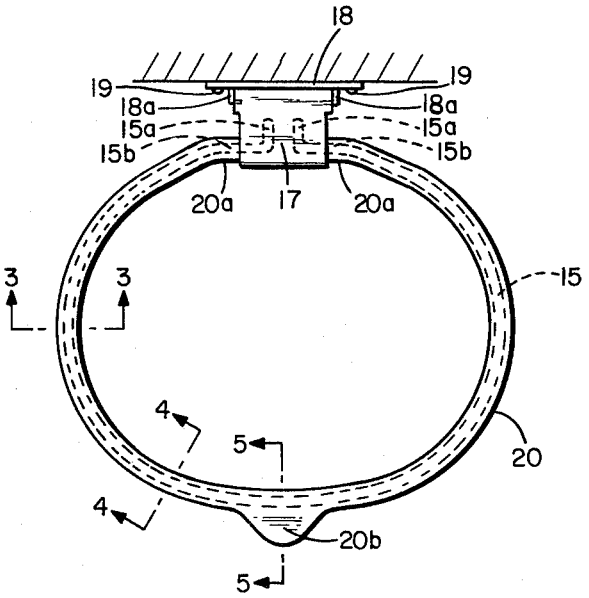
FIG. 2 is a top plan view thereof.

As disclosed in my previously identified co-pending U.S. Patent Application, a bag mounting ring or rod 15 is provided. This mounting ring 15 is fixed to a mounting member 17 which, in the form shown, constitutes a solid block of material such as metal or a suitable plastic material, many of which are well known in the art. The rod 15 has anchoring elements 15*a* formed on the inner ends thereof as by bending the end portions of the rod. These ends 15*a* are embedded in the mounting block 17, as best shown in FIG. 2. The end portions of the rod 15 provide torsional cantilever support for the rod 15 and the angle at which the anchoring elements 15*a* are disposed in the block 17 is designed to provide inwardly directed resultant forces on the portions of the block surrounding the same. Also, as disclosed in my previously identified application, this angle is approximately 45° and the block 17 is provided with a pair of mounting flanges which are received in a pair of channel elements 18*a* which are formed by the mounting plate 18. The plate 18 may be attached to the wall by screw elements 19 as illustrated.

Figure 3:
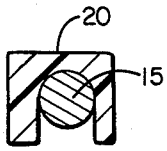
FIG. 3 is a fragmentary vertical sectional view taken substantially along the line 3—3 of FIG. 2.

A bag B, usually made from plastic sheet material, is mounted on the ring 15 and is attached thereto by means of a bag clamping ring 20 which, in the form shown in FIG. 3, has a bottom clamping channel formed therein to receive the rod 15 and anchor the bag thereto. The ring segment 20 is substantially co-terminus with mounting or supporting rod 15, as illustrated, and the ends of the clamping ring 20 are provided with attachment hinge portions 20*a* which closely surround and pivotally grip the rod 15 adjacent to mounting block 17. These mounting elements 20*a* at the ends of the clamping ring 20 are split for insertion over and around straight pivot portions 15*b* of rod 15 but securely grip said rod portions 15*b* to provide a pivotal anchor for the clamping ring 20. It will be apparent that considerable force is required to remove the ring mounting elements 20*a* from the rod 15 so that a pivotal mounting hinge for the clamping ring 20 is provided. This permits the ring to swing upwardly into raised position to permit changing the bags. The hinge portions 15*b* and 20*a* of the rings 15 and 20 adjacent to and extending laterally outwardly from the mounting block 17 are initially straight and have the circular portions positioned laterally outwardly from the straight mounting portions at an angle sufficient to permit clearance of the clamping ring 20 as it is raised into its upper raised position as described in my prior application.

Figure 4:
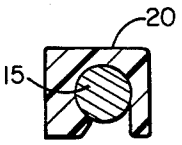
FIG. 4 is a fragmentary vertical section view taken substantially along the line 4—4 of FIG. 2.
Figure 5:
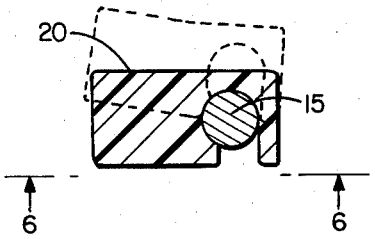
FIG. 5 is a fragmentary vertical sectional view taken substantially along the line 5—5 of FIG. 2; and, FIG. 6 is a fragmentary bottom plan as viewed from plane 6—6 of FIG. 5.
Figure 6:
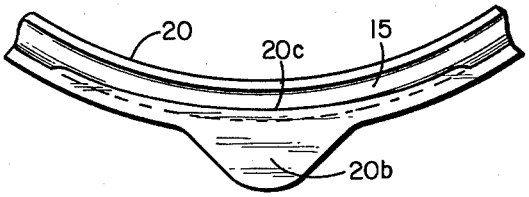

In this invention, the ring 20 is positively retained in clamping position on the mounting ring 15 by an underlying lip element 20*c* which extends around a substantial circumferential portion of the front of the mounting ring 15, as best shown in bottom plan view, FIG. 6, and also in the two cross sectional views, FIGS. 4 and 5. The underlying locking lip 20*c* formed around the lower edge of the outer thickened portion of the clamping ring 20 snaps around and under a substantial circumferential cross sectional portion of the rod 15. A protuberance 20*b* provides additional stiffness and reinforcing at the center front portion of the clamping ring 20, as best shown in FIG. 6, and also provides a gripping handle for raising the clamping ring 20 above the mounting ring 15.

What is claimed is:

1. A bag holder comprising a generally cylindrical mounting ring adapted to be connected at its rear portion to a suitable supporting structure, a clamping member made from resilient, integrally moulded material with an underlying generally inverted U-shaped cross section defining an inner and an outer clamping arm with an opening therebetween which has an interfering fit with the outside of the mounting ring when the ring is received therein to securely clamp the upper portion of a bag to said mounting ring, a forwardly extending protuberance formed at the outer portion of said clamping member to provide a grip for removing the clamp from the ring and for substantially reinforcing the outer portion of the clamping member to insure a positive lock around the outer portion of the mounting ring when the bag is in clamped position, and the outer arm of the U-shaped clamping member is substantially thicker than the inner arm thereof to reinforce the outer arm portion and provide a secure clamping action around substantially the entire circumference of the ring and at least the outer peripheral portion of the clamping member extending around a substantial cross sectional portion of the mounting ring with the thickened outer arm forming a lip which underlies a substantial portion of the front underlying cross sectional portion of the mounting ring to positively lock at least the forward circumferential portion of the clamping member onto the mounting ring.

2. The structure set forth in claim 1 wherein the mounting ring has a circular cross sectional shape and the inverted U-shape channel of the clamping member extends around more than 180° of the circular cross section of the ring at least at the forward portion thereof.

* * * * *